US007416441B2

(12) United States Patent
Nishiyama

(10) Patent No.: US 7,416,441 B2
(45) Date of Patent: Aug. 26, 2008

(54) ELECTRONIC APPARATUS

(75) Inventor: Shigeki Nishiyama, Hino (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/640,298

(22) Filed: Dec. 18, 2006

(65) Prior Publication Data

US 2007/0178755 A1 Aug. 2, 2007

(30) Foreign Application Priority Data

Jan. 31, 2006 (JP) ..... 2006-022452

(51) Int. Cl.
*H01R 13/60* (2006.01)

(52) U.S. Cl. ..... 439/529; 439/457

(58) Field of Classification Search ..... 439/352, 439/528, 534, 457–460
See application file for complete search history.

(56) References Cited

U.S. PATENT DOCUMENTS 4,710,137 A * 12/1987 Perdue et al. ..... 439/457
7,112,086 B1 * 9/2006 Wu ..... 439/460

FOREIGN PATENT DOCUMENTS

| | | |
|---|---|---|
| JP | 2001-052818 | 2/2001 |
| JP | 2004-154462 | 6/2004 |
| JP | 3106922 U | 11/2004 |

* cited by examiner

*Primary Examiner*—Truc T Nguyen
(74) *Attorney, Agent, or Firm*—Pillsbury Winthrop Shaw Pittman, LLP

(57) ABSTRACT

According to one embodiment, an electronic apparatus is provided with a case, a module contained in the case and including a first hole portion and a connector, a cable connected electrically to the connector, a fixture which is inserted in the first hole portion and fixes the module in the case, and a cover which covers the connector, includes a second hole portion communicating with the first hole portion, and is fixed in combination with the module by the fixture.

11 Claims, 9 Drawing Sheets

ELECTRONIC APPARATUS

CROSS-REFERENCE TO RELATED APPLICATIONS

This application is based upon and claims the benefit of priority from Japanese Patent Application No. 2006-022452, filed Jan. 31, 2006, the entire contents of which are incorporated herein by reference.

BACKGROUND

1. Field

One embodiment of the invention relates to an electronic apparatus mounted with a module in its case, for example, to a structure for restricting free removal relating to a module.

2. Description of the Related Art

An electronic apparatus, such as a portable computer, is equipped with modules mounted within its case. Modules of various types may be mounted in the electronic apparatus. Some of these modules are designed to restrict a user's free removal in view of safety or prevention of a failure of the electronic apparatus.

For example, as regards a module to which an antenna cable is connected, wireless LAN standards prohibit removal of the module itself and the cable connected to it (see, e.g., U.S. Wireless Standard FCC-15 407(d)).

A game machine, control elements of which cannot be removed with ease, is disclosed in Jpn. Pat. Appln. KOKAI Publication No. 2004-154462, for example. This game machine comprises a control board to which the control elements are attached and a removal preventing member for preventing removal of the control elements. The removal preventing member has a supporting member, a holding plate, and a locking member.

The supporting member is provided in front of the control elements on the control board. The locking member is provided behind the control elements on the control board. The holding plate is located ranging from the supporting member to the locking member. Since the holding plate closely covers the control elements from above, it is difficult to remove the control elements.

In mounting in the case the removal preventing member for preventing the removal of the module, it is fixed on, for example, a circuit board that is situated off the module. Specifically, the removal preventing member requires accommodation space that extends beyond a region for the module. Further, a member or a hole for fixing the module must be formed on the circuit board.

For example, the holding plate of the game machine is fixed to the control board with the supporting member and the locking member between them. Thus, the supporting member and the locking member are provided on the control board in order to fix the holding plate.

On the other hand, modern electronic apparatuses require further miniaturization, and members associated with the module are expected to be mounted as efficiently as possible. If a wide space, fixing member, or hole is needed to attach the removal preventing member or the holding plate, the mounting cannot be regarded as efficient.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an electronic apparatus is provided with a case, a module contained in the case and including a first hole portion and a connector, a cable connected electrically to the connector, a fixture which is inserted in the first hole portion and fixes the module in the case, and a cover which covers the connector, includes a second hole portion communicating with the first hole portion, and is fixed in combination with the module by the fixture.

Embodiments of the present invention applied to portable computers will now be described with reference to the accompanying drawings.

Figure 1:
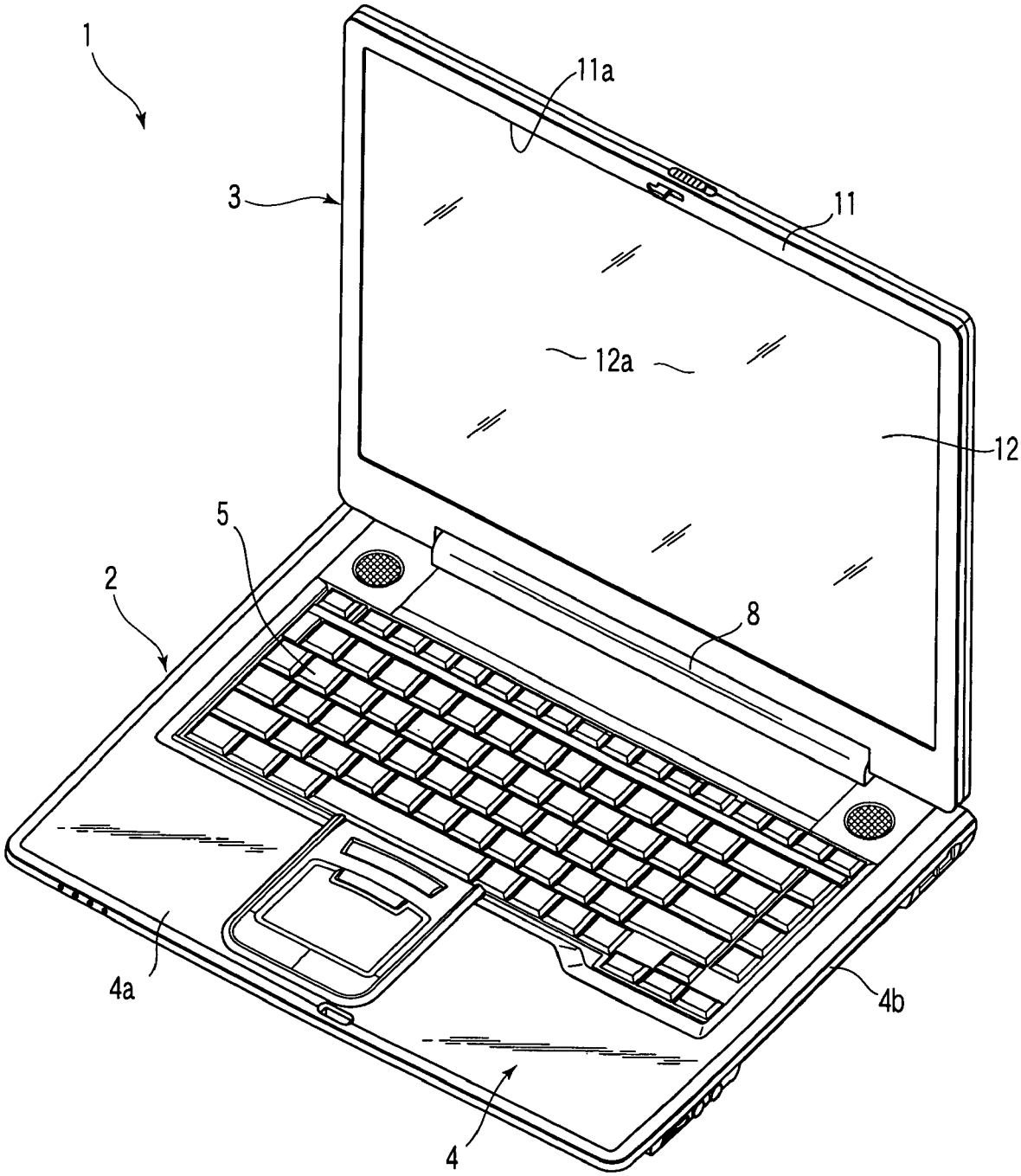
FIG. 1 is an examplary perspective view of a portable computer according to a first embodiment of the invention.

FIGS. 1 to 5 show a portable computer 1 as an electronic apparatus according to a first embodiment of the invention. As shown in FIG. 1, the portable computer 1 is provided with a body 2 and a display unit 3. The body 2 has a case 4. The case 4 is in the form of a box having a top wall 4*a*, a side wall 4*b*, and a bottom wall (not shown). The top wall 4*a* supports a keyboard 5.

Figure 2:
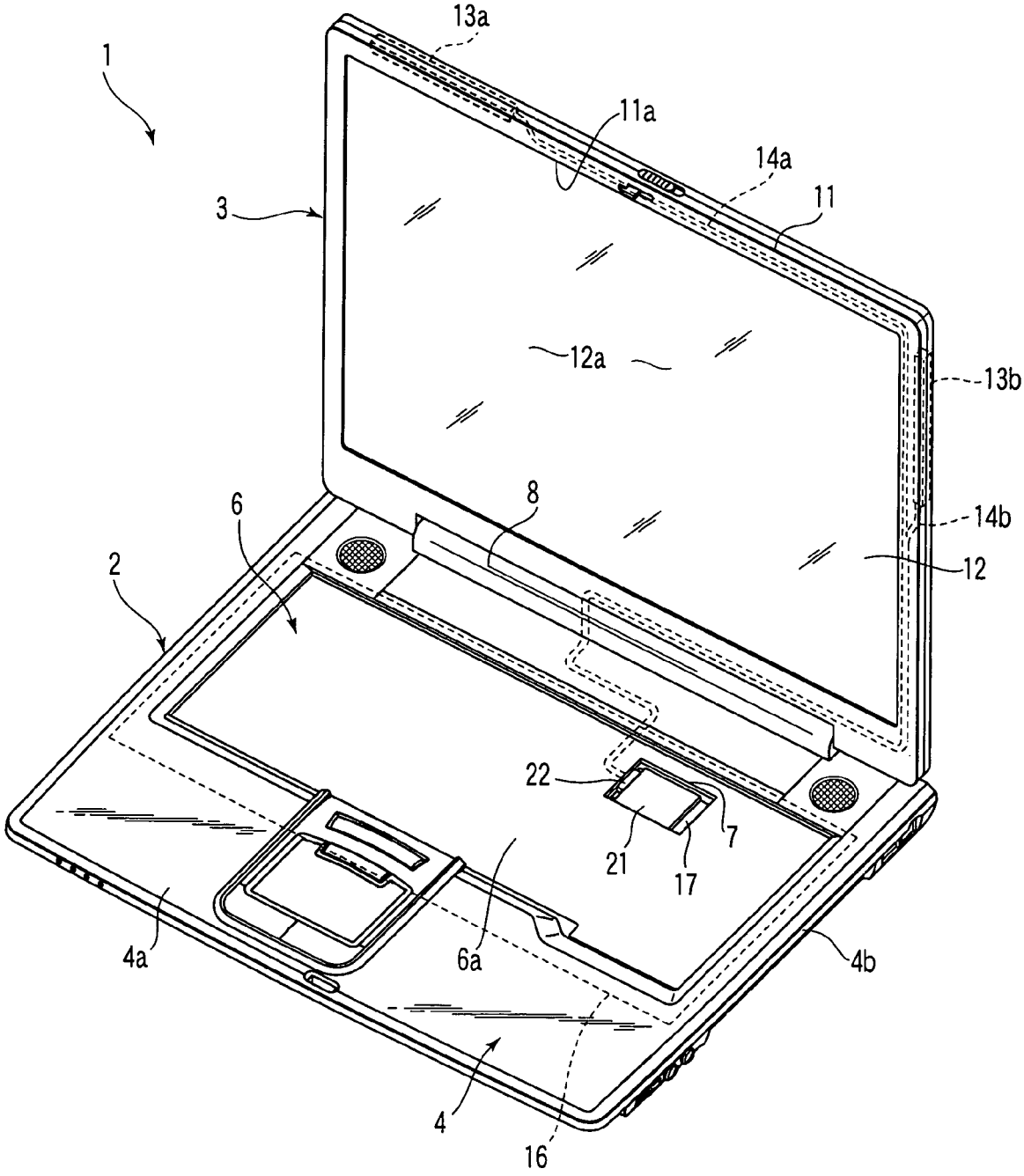
FIG. 2 is an examplary partially cutaway perspective view of the portable computer of the first embodiment.

FIG. 2 shows the case 4 that is cleared of the keyboard 5. As shown in FIG. 2, the top wall 4*a* has a keyboard mounting section 6. The keyboard mounting section 6 has a hollow that is a little larger than the contour of the keyboard 5. The keyboard mounting section 6 has a bottom wall 6*a*. The keyboard 5 is removably set on the bottom wall 6*a*. An opening 7 is formed in the bottom wall 6*a*. The opening 7 opens into the case 4.

As shown in FIG. 2, a hinge section 8 is provided at the rear end portion of the body 2. The hinge section 8 swingably supports the display unit 3. Thus, the display unit 3 is swingable between a closed position in which it covers the top wall 4*a* from above and an open position in which it is set upright to allow the top wall 4*a* to be exposed.

The display unit 3 is provided with a display housing 11 and a liquid crystal display panel 12 in the housing 11. The display panel 12 has a display screen 12*a*. The display screen 12*a* is exposed to the outside of the display housing 11 through an opening 11*a* in the front face of the housing 11.

As shown in FIG. 2, the display housing 11 contains a pair of antennas 13*a* and 13*b*. One of the ends of each of coaxial cables 14*a* and 14*b* is connected electrically to each of the antennas 13*a* and 13*b*, respectively. The other ends of the cables 14*a* and 14*b* are guided from the display unit 3 into the case 4 of the body 2 through the hinge section 8.

Figure 3:
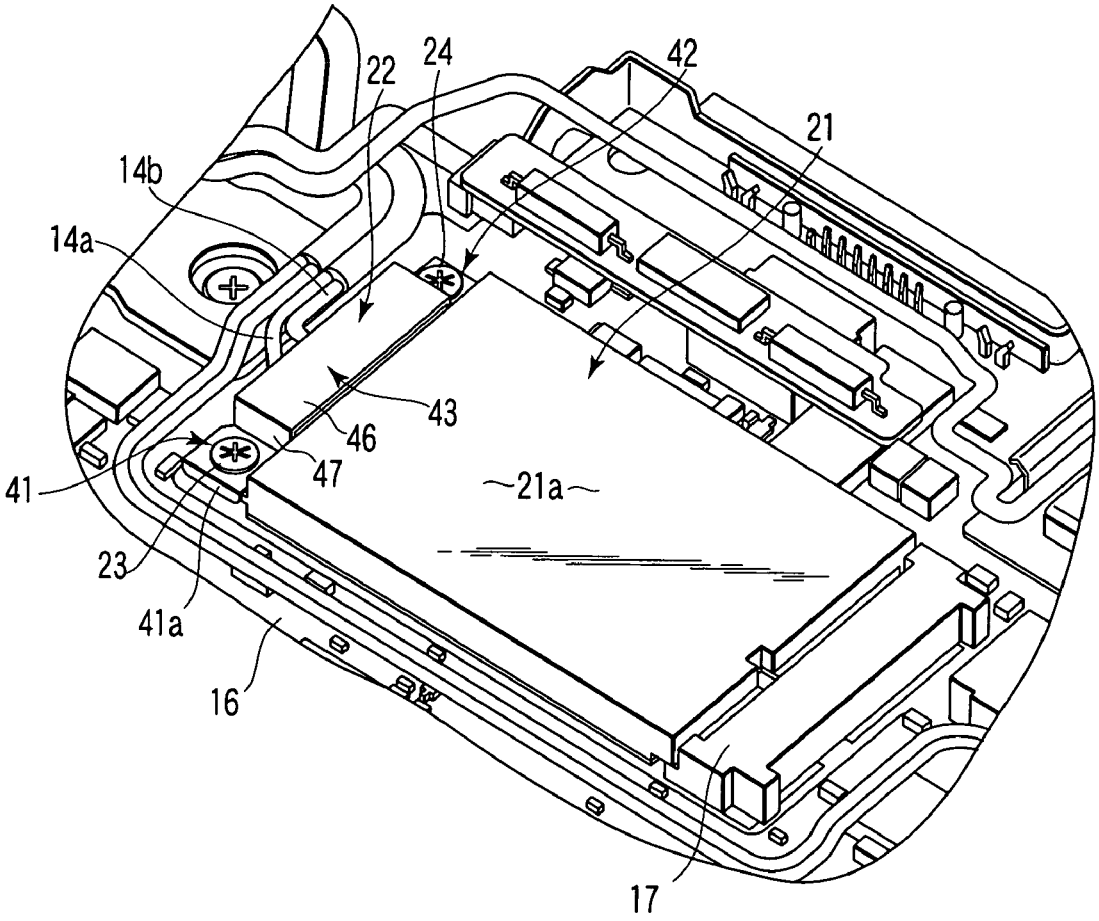
FIG. 3 is an examplary perspective view showing a card module according to the first embodiment and its surroundings.
Figure 4:
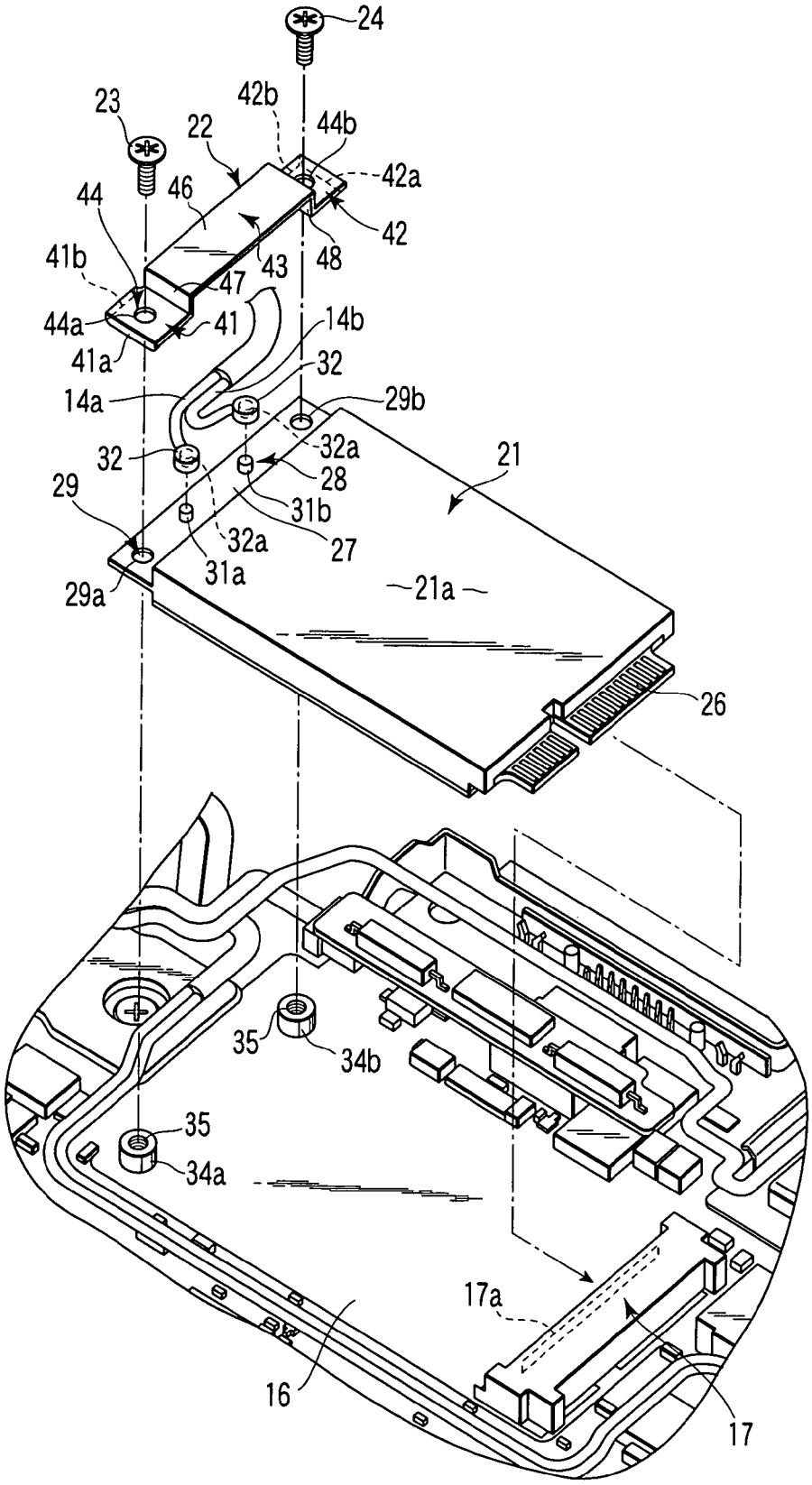
FIG. 4 is an examplary exploded perspective view showing the card module of the first embodiment and its surroundings.

As shown in FIG. 2, the case 4 contains a circuit board 16. As shown in FIG. 3, a connector 17 for module connection is mounted on the circuit board 16. A connector that complies with the Minicard module standards is an example of the connector 17 for module connection. The connector 17 is connected electrically to the circuit board 16. As shown in FIG. 4, a slot 17*a* opens in one end of the connector 17.

As shown in FIG. 4, the case 4 further contains a card module 21, a cover 22, and first and second screws 23 and 24. The cover 22 is an example of a removal preventing member. The first screw 23 is an example of a first fixing member. The second screw 24 is an example of a second fixing member.

A wireless LAN module that complies with the Minicard module standards is an example of the card module 21. The module 21 has a connection pad portion 26, mounting portion 27, connector portion 28, and first hole portion 29.

The connection pad portion 26 is provided on one longitudinal end of the card module 21. The pad portion 26 has a plurality of connection pads and is configured to be inserted into the slot 17*a* of the connector 17 for module connection. Thus, the card module 21 is connected electrically to the circuit board 16 through the connector 17.

The mounting portion 27 is provided on the other longitudinal end of the card module 21. The mounting portion 27 is thinner than the other part of the module 21. The mounting portion 27 is formed covering the whole width of the module 21.

As shown in FIG. 4, the connector portion 28 is disposed on the central part of the mounting portion 27. The connector portion 28 has a pair of connectors 31*a* and 31*b*. The connectors 31*a* and 31*b* are arranged apart from each other in the width direction of the card module 21. Each of the connectors 31*a* and 31*b* is an electrically conductive, cylindrical protrusion that protrudes upward from the mounting portion 27. The coaxial cables 14*a* and 14*b* are connected electrically to the connectors 31*a* and 31*b*, respectively.

Each of the coaxial cables 14*a* and 14*b* has a terminal 32 on its distal end. The terminal 32 is a cylinder having an opening 32*a* that opens downward. When the connectors 31*a* and 31*b* are fitted in the openings 32*a* of the terminals 32, respectively, the coaxial cables 14*a* and 14*b* are connected electrically to the card module 21.

According to the Minicard module standards, the module is fixed by screwing in the case 4 (see, e.g., "PCI express MINI CARD ELECTROMECHANICAL SPECIFICATION"). The card module 21 according to the present embodiment is a module that complies with the standards. Based on the standards, therefore, the module 21 has the first hole portion 29 at its one end.

The first hole portion 29 has a first hole 29*a* and a second hole 29*b*. The first and second holes 29*a* and 29*b* are arranged apart from each other at their corresponding opposite end parts of the mounting portion 27 with the connectors 31*a* and 31*b* between them. The holes 29*a* and 29*b* are through holes that individually penetrate the mounting portion 27 in the vertical direction.

Figure 5:
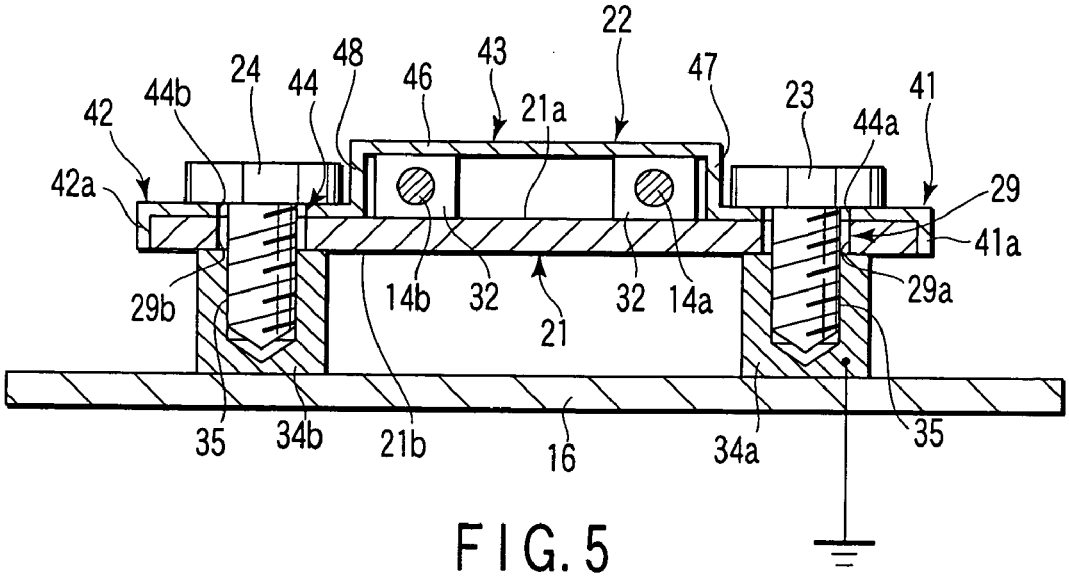
FIG. 5 is an examplary sectional view showing the card module of the first embodiment and its surroundings.

As shown in FIGS. 4 and 5, the circuit board 16 is provided with first and second studs 34*a* and 34*b*. The first stud 34*a* is located under and corresponding to the first hole 29*a*. The second stud 34*b* is located under and corresponding to the second hole 29*b*. The first and second studs 34*a* and 34*b* have their respective threaded holes 35 that open upward.

The first and second holes 29*a* and 29*b* of the card module 21 communicate with the threaded holes 35 of the first and second studs 34*a* and 34*b*, respectively. For example, each of the studs 34*a* and 34*b* is formed of an electrically conductive material, such as a metal. The studs 34*a* and 34*b* are connected electrically to a ground layer (not shown) of the circuit board 16.

In the description to follow, the direction from the mounting portion 27 toward the connector 17 for module connection is defined as "forward;" the direction from the center of the mounting portion 27 toward the first hole 29*a*, as "rightward;" and the direction from the center of the mounting portion 27 toward the second hole 29*b*, as "leftward."

As shown in FIGS. 3 and 4, the cover 22 is set on the mounting portion 27. The longitudinal length of the cover 22 is substantially equal to the width of the card module 21. An example of the cover 22 is formed of sheet metal, such as a stainless-steel sheet. Alternatively, however, the cover 22 may be formed of a molded product of synthetic resin, for example.

The cover 22 has a first fixing portion 41, a second fixing portion 42, and a cover portion 43.

The first fixing portion 41 is provided at the right-hand end portion of the cover 22. A third hole 44*a* opens in the first fixing portion 41. It is situated in a position corresponding to the first hole 29*a* of the card module 21 and communicates with the hole 29*a*.

The second fixing portion 42 is provided at the left-hand end portion of the cover 22. A fourth hole 44*b* opens in the second fixing portion 42. It is situated in a position corresponding to the second hole 29*b* of the card module 21 and communicates with the hole 29*b*. The third and fourth holes 44*a* and 44*b* collaborate and form an example of a second hole portion 44.

As shown in FIG. 4, the first fixing portion 41 has a right-hand bent portion 41*a* and a rear bent portion 41*b*. The right-hand bent portion 41*a* bends downward from the right-hand end of the first fixing portion 41. The rear bent portion 41*b* bends downward from the rear end of the first fixing portion 41. The bent portions 41*a* and 41*b* are in contact with the right-hand and rear ends, respectively, of the card module 21.

The second fixing portion 42 has a left-hand bent portion 42*a* and a rear bent portion 42*b*. The left-hand bent portion 42*a* bends downward from the left-hand end of the second fixing portion 42. The rear bent portion 42*b* bends downward from the rear end of the second fixing portion 42. The bent portions 42*a* and 42*b* are in contact with the left-hand and rear ends, respectively, of the card module 21.

The cover portion 43 is provided between the first and second fixing portions 41 and 42. It has a ceiling wall 46 and side walls 47 and 48. As shown in FIG. 5, the ceiling wall 46 is formed so as to be at least higher than the upper surfaces of the terminals 32 of the coaxial cables 14*a* and 14*b*. As shown in FIG. 5, an example of the ceiling wall 46 covers a region over the connectors 31*a* and 31*b* without leaving any substantial gap between itself and the terminals 32. Alternatively, however, the cover portion 43 may be located leaving a predetermined gap over the connectors 31*a* and 31*b*.

The paired side walls 47 and 48 extend from the left- and right-hand sides of the ceiling wall 46 toward the first and second fixing portions 41 and 42 and connect the ceiling wall 46 to the fixing portions 41 and 42, respectively. Specifically, the cover 22 is mounted on the card module 21 so as to span the connector portion 28 and conceals the terminals 32 of the coaxial cables 14*a* and 14*b* under it. The cover 22 protects the connector portion 28 by restricting users' access to the connector portion 28.

As shown in FIG. 4, the first screw 23 is inserted into the third hole 44*a* and the first hole 29*a* and engages the threaded hole 35 of the first stud 34*a*. The second screw 24 is inserted into the fourth hole 44*b* and the second hole 29*b* and engages the threaded hole 35 of the second stud 34*b*. Thereupon, the card module 21 is fixed to the circuit board 16. The cover 22 is fixed in combination with the module 21 in the case 4. Specifically, the first and second screws 23 and 24 collaborate and function as one example of fixture for fixing the module 21 in the case 4.

The first and second screws 23 and 24 are TORX (trademark, Textron Inc.) screws that are prescribed by "JASO F116-89" (Japanese Automobile Standards Organization), for example. The TORX screws can be disengaged only by using a dedicated tool (TORX tool) for them. The TORX tool is not popular among general users.

The first and second screws 23 and 24 are not limited to the TORX screws but may be any conventional screws. In fixing the module that complies with the wireless LAN standards, the first and second screws 23 and 24 may be some special screws that cannot be disengaged by means of a popular general-purpose tool, for example.

The "special screws" as used herein represent, for example, TORX screws, two-hole screws, tri-wing screw, tri- or penta-symmetrical screws, or some other screws that are not popular among general users.

The cover 22 is grounded as the first and second screws 23 and 24 are fitted in the first and second studs 34*a* and 34*b*, respectively.

The following is a description of the assembly and operation of the portable computer 1.

The card module 21 is attached to and detached from the connector 17 for module connection through the opening 7 of the keyboard mounting section 6. After the module 21 is attached to the connector 17, the coaxial cables 14*a* and 14*b* are connected to the connectors 31*a* and 31*b*, respectively. Alternatively, the coaxial cables 14*a* and 14*b* may be connected to their corresponding connectors 31*a* and 31*b* before the module 21 is attached to the connector 17.

After the coaxial cables 14*a* and 14*b* are connected to the connectors 31*a* and 31*b*, respectively, the cover 22 is set on the mounting portion 27 in a manner such that the cover portion 43 covers the connector portion 28. The third and fourth holes 44*a* and 44*b* are aligned with the first and second holes 29*a* and 29*b*, respectively. In setting the cover 22 on the mounting portion 27, the cover 22 can be appropriately aligned by locating the right-hand and rear bent portions 41*a* and 41*b* of the first fixing portion 41 and the left-hand and rear bent portions 42*a* and 42*b* of the second fixing portion 42 along an edge of the mounting portion 27.

After the cover 22 is set on the mounting portion 27, the first screw 23 is inserted into the third hole 44*a* and the first hole 29*a* and screwed into the threaded hole 35 of the first stud 34*a*. The second screw 24 is inserted into the fourth hole 44*b* and the second hole 29*b* and screwed into the threaded hole 35 of the second stud 34*b*. Thereupon, the cover 22 is fixed in combination with the card module 21 to the circuit board 16.

When the cover 22 is attached to the mounting portion 27, the connector portion 28 is covered by the cover 22. When the cover 22 covers the connector portion 28, a user is restricted from freely removing the coaxial cables 14*a* and 14*b*. If special screws such as the TORX screws are used for the first and second screws 23 and 24, moreover, the user is restricted from freely removing the module itself.

According to the portable computer 1 constructed in this manner, members associated with the card module 21 can be mounted efficiently. Specifically, the first and second screws 23 and 24 are fixing members for fixing the module 21. The cover 22 according to the present embodiment is fixed by the use of the screws 23 and 24. Since the screws 23 and 24 are used to fix the cover 22, screws for fixing the cover 22 can be omitted.

The omission of the screws for fixing the cover 22 leads to a reduction in cost of the portable computer 1. Based on the use of the first and second screws 23 and 24, the cover 22 is fixed at the same time as the card module 21 is fixed. Since the cover 22 is fixed in combination with the module 21, time to fasten the screws for fixing the cover 22 can be saved, so that the assemblability of the computer 1 can be improved.

Since the first and second screws 23 and 24 are used to attach the cover 22, the cover 22 can be miniaturized to a size such that it can be confined within the area of the card module 21. Specifically, the cover 22 need not be made to extend to a region off the module 21. Thus, a space required by the cover 22 is reduced, so that the mounting areas of the members associated with the card module 21 are reduced. In other words, the mounting efficiency of these associated members is enhanced.

If the card module 21 is in compliance with the aforementioned Minicard module standards, the first and second screws 23 and 24 are members for fixing the card module 21 according to the standards. By the use of the screws 23 and 24, the portable computer 1 can be efficiently equipped with the members associated with the card module 21 without failing to meet the above standards.

If the first and second holes 29*a* and 29*b* are arranged with the connectors 31*a* and 31*b* between them and when the cover 22 is fixed by means of the first and second screws 23 and 24, the cover 22 covers the connectors 31*a* and 31*b* and is firmly fixed in the case 4.

A portable computer 61 as an electronic apparatus according to a second embodiment of the invention will now be described with reference to FIGS. 6 to 12. Like numerals are used to designate like configurations that have the same functions as those of the portable computer 1 according to the first embodiment, and a description of those configurations is omitted.

Figure 6:
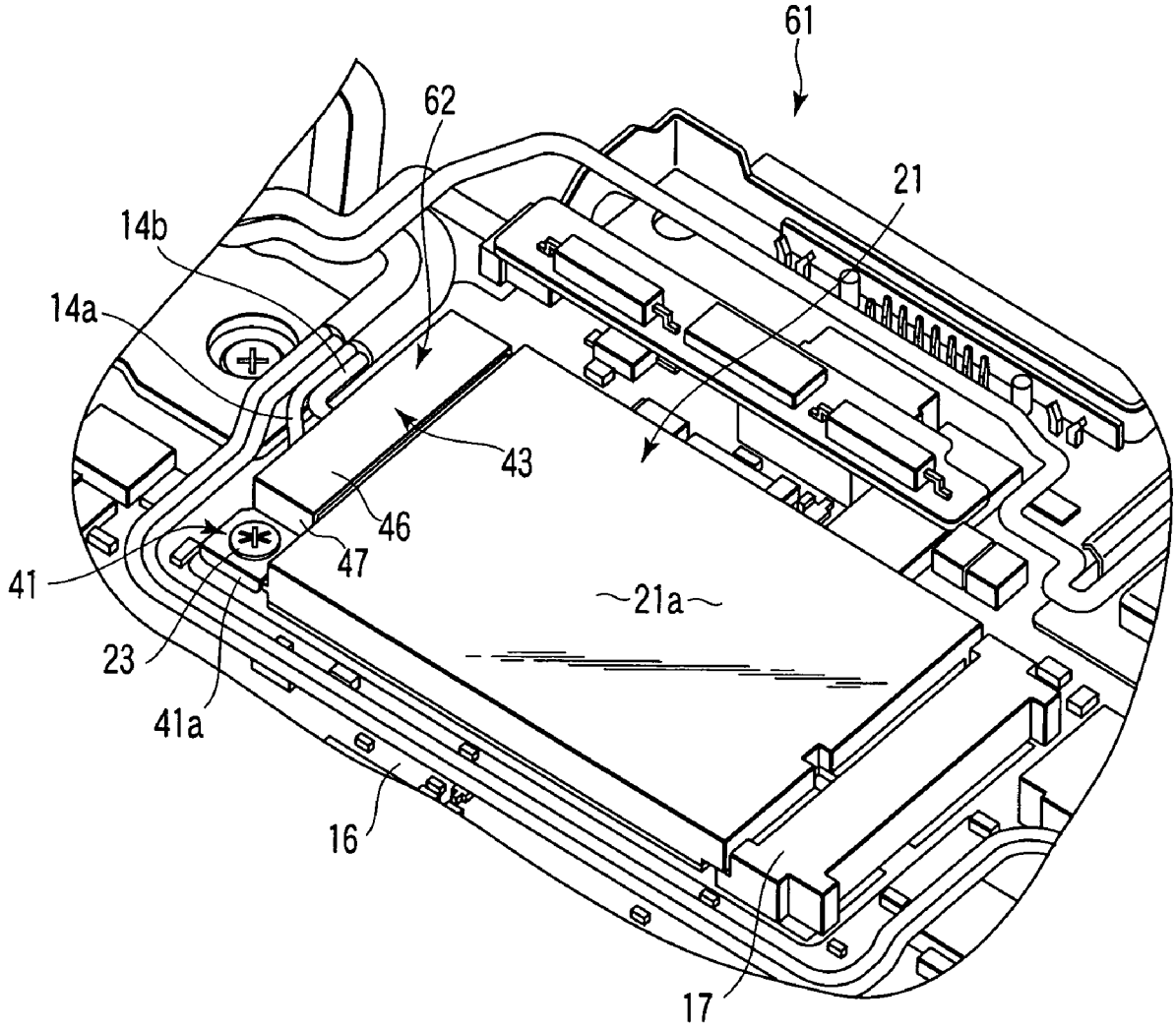
FIG. 6 is an examplary perspective view showing a card module of a portable computer according to a second embodiment of the invention and its surroundings.
Figure 7:
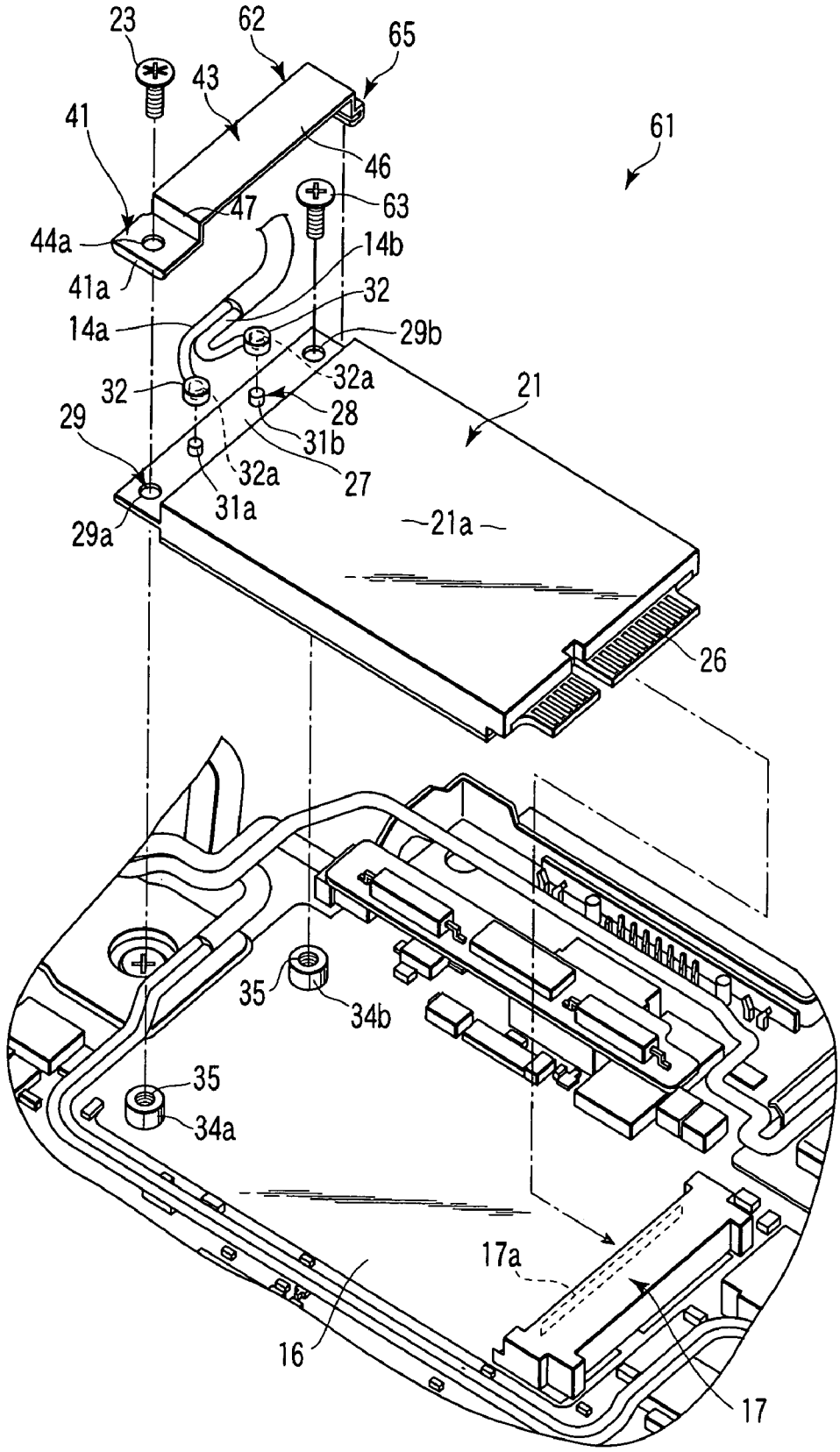
FIG. 7 is an examplary exploded perspective view showing the card module of the second embodiment and its surroundings.

As shown in FIGS. 6 and 7, a case 4 of the portable computer 61 contains a card module 21, a cover 62, and first and second screws 23 and 63. The cover 62 is an example of a removal preventing member. The second screw 63 is an example of a second fixing member.

Figure 8:
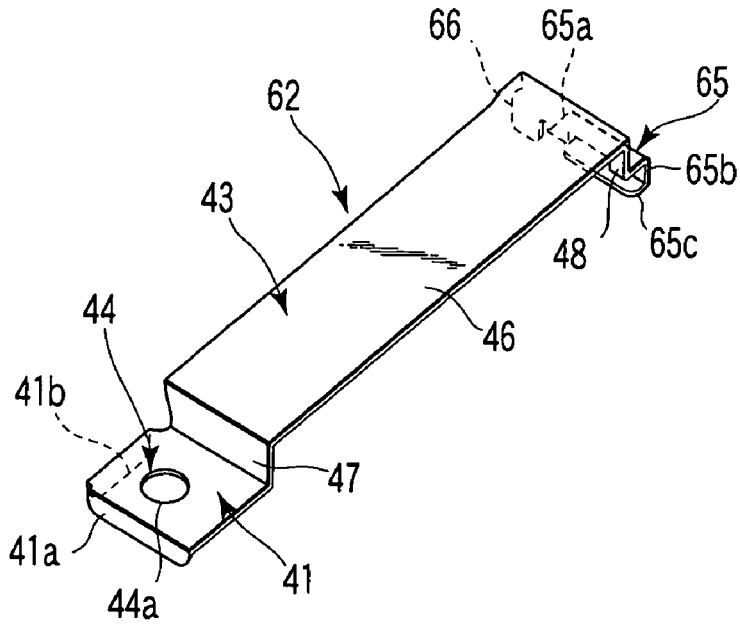
FIG. 8 is an examplary perspective view of a cover according to the second embodiment.
Figure 9:
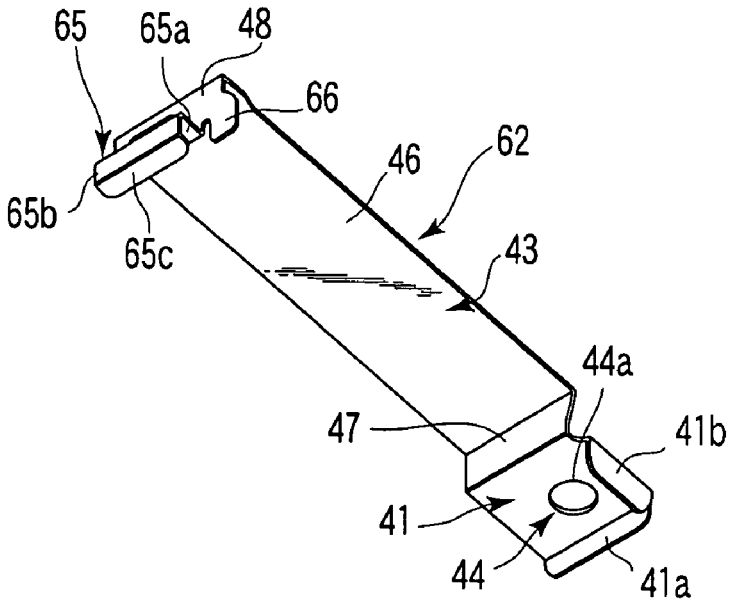
FIG. 9 is an examplary perspective view of the cover shown in FIG. 8 taken from another angle.
Figure 12:
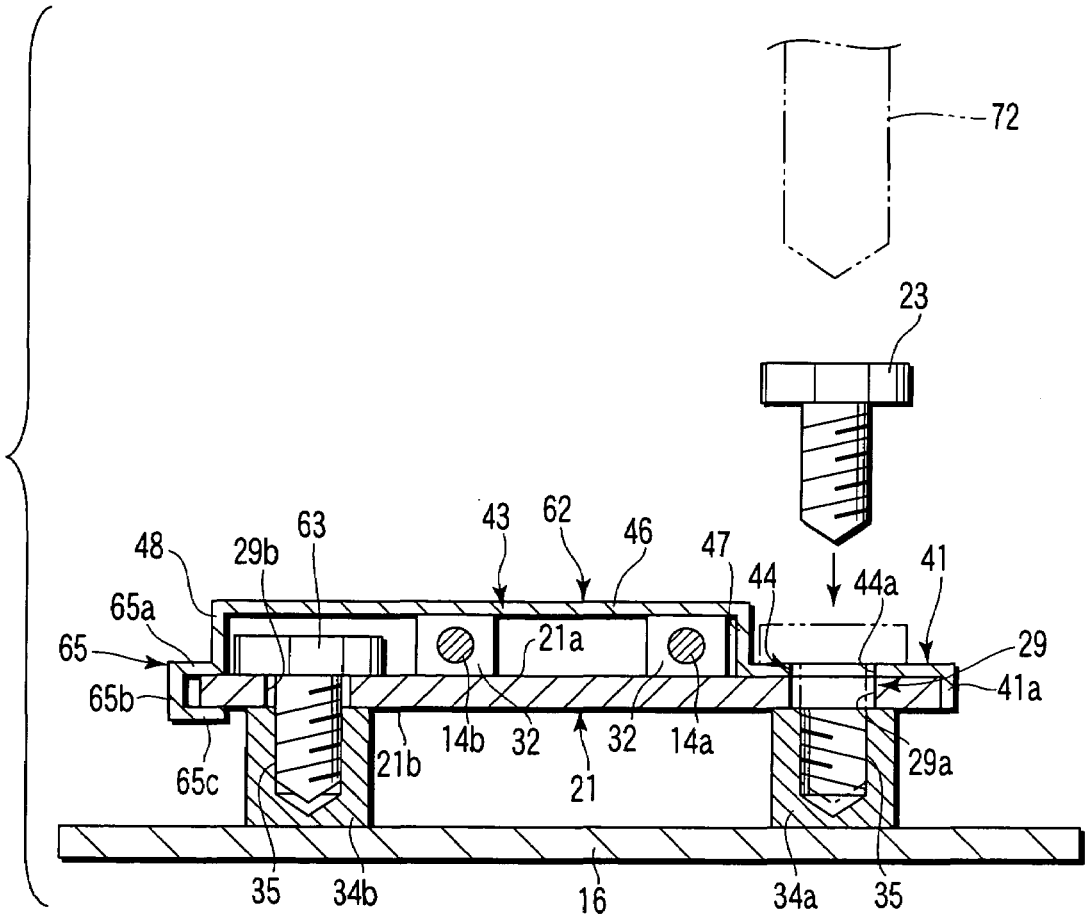
FIG. 12 is an examplary sectional view showing how a first screw is attached to the card module shown in FIG. 11.

The cover 62 is set on a mounting portion 27. The length of the cover 62 is substantially equal to the width of the card module 21. As shown in FIGS. 8 and 9, the cover 62 has a first fixing portion 41, a cover portion 43, and a hook portion 65. As shown in FIG. 12, the cover portion 43 covers a region over a connector portion 28 and the second screw 63 that is inserted in a second hole 29*b*.

The hook portion 65 is an example of a retaining portion. It is disposed on an end portion of the cover 62 opposite from the first fixing portion 41. The hook portion 65 has a first member 65*a*, a second member 65*b*, and a third member 65*c*.

As shown in FIG. 12, the first member 65*a* extends along an upper surface 21*a* of the card module 21 from the lower end of the side wall 48 of the cover portion 43 toward the outside of the module 21. The second member 65*b* extends from an extended end of the first member 65*a* toward a circuit board 16 or downward to a position a little below a lower surface 21*b* of the module 21. The third member 65*c* extends along the lower surface 21*b* of the module 21 from the distal end of the second member 65*b* toward the inside of the module 21.

The hook portion 65 engages an end portion of the card module 21 in such a manner that the first, second, and third members 65*a*, 65*b* and 65*c* round an edge of the module 21 or that the third member 65*c* engages the lower surface 21*b* of the module 21. The upper surface 21*a* of the module 21 is a surface to which the cover portion 43 is opposed.

As the hook portion 65 engages with the end portion of the card module 21, the end portion of the cover 62 on which the hook portion 65 is located is fixed to the module 21.

The side wall 48 of the cover portion 43 that adjoins the hook portion 65 has a position adjusting portion 66. The position adjusting portion 66 protrudes from the rear end portion of the side wall 48 toward the circuit board 16 and extends to a position below the upper surface 21*a* of the card module 21. It touches the rear end portion of the module 21.

As shown in FIG. 7, the first screw 23 can be inserted into a third hole 44*a* and a first hole 29*a* and fitted into a threaded hole 35 of a first stud 34*a*. The cover 62 is fixed in combination with the card module 21 by the first screw 23. The first screw 23 functions as part of a fixture that fixes the module 21 in the case 4.

The second screw 63 is of a type different from the first screw 23. A head hole of the second screw 63 is different from that of the first screw 23. In other words, a fixing tool 71 that engages the head hole of the second screw 63 is different from a fixing tool 72 that engages the head hole of the first screw 23.

An example of the second screw 63 is a conventional screw. The "conventional screw" as used herein implies a popular screw, such as a slotted head screw or Phillips head screw. An example of the fixing tool 71 is a flat-blade or Phillips screwdriver.

The second screw 63 is not limited to the conventional screw but may be a screw of the same type as the first screw 23, e.g., a TORX screw.

The assembly and operation of the portable computer 61 will now be described with reference to FIGS. 10 to 12.

Figure 10:
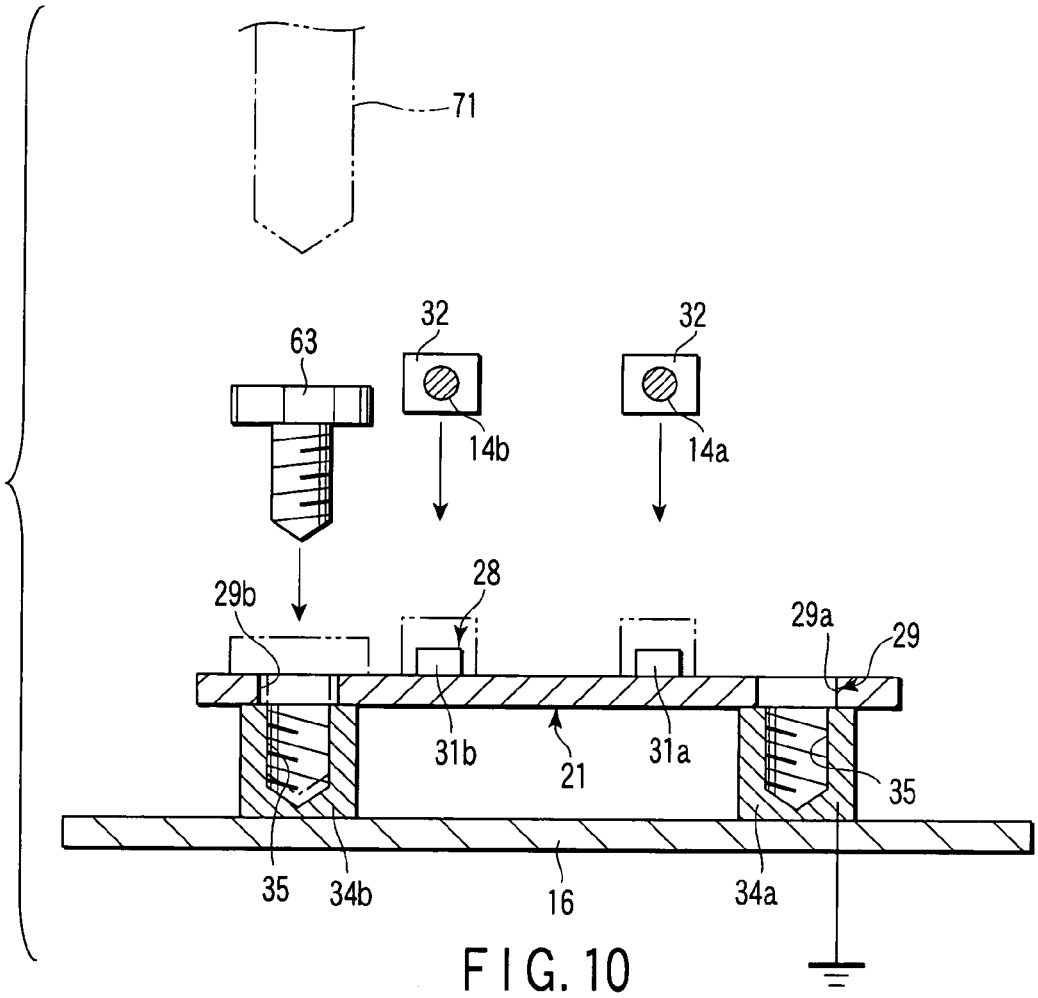
FIG. 10 is an examplary sectional view showing how a second screw is attached to the card module shown in FIG. 6.

After the connection pad portion 26 of the card module 21 is plugged into the slot 17*a* of the connector 17 for module connection, the second screw 63 is inserted into the second hole 29*b* and fitted into the threaded hole 35 of a second stud 34*b*, as shown in FIG. 10. After the second screw 63 is set in place, coaxial cables 14*a* and 14*b* are connected to connectors 31*a* and 31*b*, respectively. The coaxial cables 14*a* and 14*b* may alternatively be connected to the connectors 31*a* and 31*b* before the second screw 63 is set.

Figure 11:
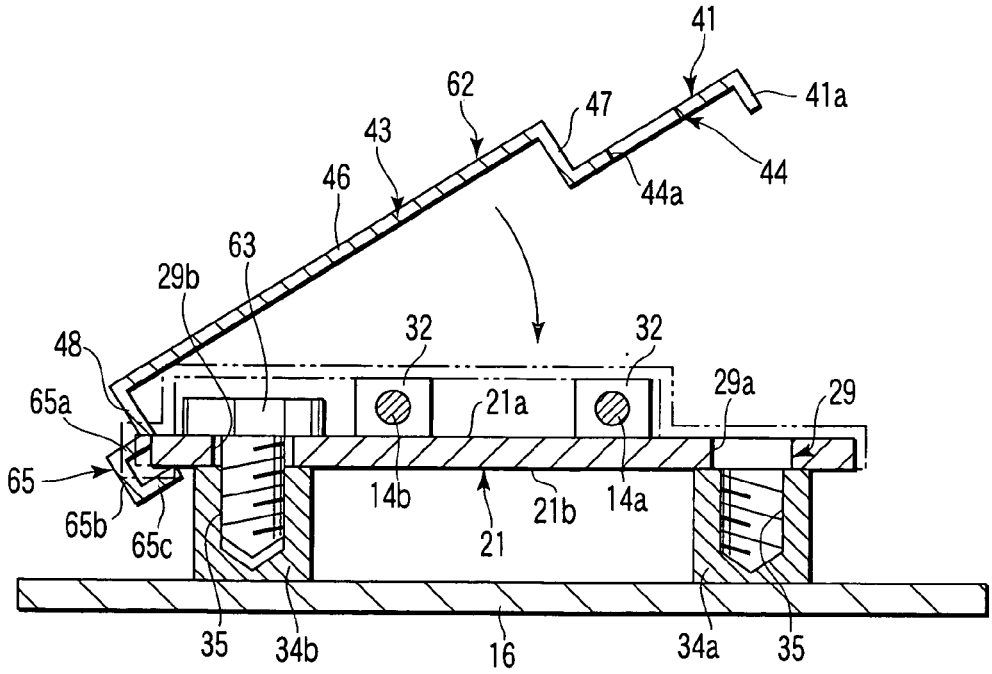
FIG. 11 is an examplary sectional view showing how the cover is attached to the card module shown in FIG. 10.

After the coaxial cables 14*a* and 14*b* are connected to the connectors 31*a* and 31*b*, respectively, as shown in FIG. 11, the cover 62 is placed on the mounting portion 27 so that the cover portion 43 covers the connector portion 28 and the second screw 63. Specifically, the hook portion 65 is hooked over the end portion of the card module 21, and the third hole 44*a* is aligned with the first hole 29*a*. In setting the cover 62 on the mounting portion 27, the cover 62 can be appropriately aligned by locating the right-hand and rear bent portions 41*a* and 41*b* of the first fixing portion 41 and the position adjusting portion 66 along an edge of the mounting portion 27.

After the cover 62 is set on the mounting portion 27, the first screw 23 is inserted into the third hole 44*a* and the first hole 29*a* and screwed into the threaded hole 35 of the first stud 34*a*, as shown in FIG. 12. Thereupon, the cover 62 is fixed in combination with the card module 21 to the circuit board 16.

When the cover 62 is attached to the mounting portion 27, the connector portion 28 and the second screw 63 are covered by the cover 62. When the cover 62 covers the connector portion 28, a user is restricted from freely removing the coaxial cables 14*a* and 14*b*. When the cover 62 covers the second screw 63, the user is restricted from freely removing the second screw 63. If a special screw, such as a TORX screw, is used for the first screw 23, moreover, the user is restricted from freely removing the module itself.

According to the portable computer 61 constructed in this manner, members associated with the card module 21 can be mounted efficiently. Specifically, the first screw 23 is part of a fixture for fixing the module 21. The cover 62 is fixed by the use of the first screw 23. Since the first screw 23 is used to fix the cover 62, screws for fixing the cover 62 can be omitted. The omission of the screws for fixing the cover 62 leads to a reduction in cost of the portable computer 61, improvement of its assemblability, and enhancement of the mounting efficiency.

If the card module 21 is in compliance with the aforementioned Minicard module standards, the first screw 23 is a member for fixing the card module 21 according to the standards. By the use of the first screw 23, the portable computer 61 can be efficiently equipped with the members associated with the card module 21 without failing to meet the above standards.

When the cover 62 covers the second screw 63 besides the connector portion 28, the user cannot freely disengage the second screw 63. Thus, if there are any standards to restrict the removal of the module, for example, the portable computer 61 can be obtained in better compliance with the standards.

In the case of the portable computer 61 according to the present embodiment, the conventional screw can be used for the second screw 63. Thus, the user cannot disengage the second screw 63 without disengaging the first screw 23. If a special screw, such as a TORX screw, is used for the first screw 23, user removal can be restricted despite the use of the conventional screw for the second screw 63. In other words, the number of special screws used can be reduced without failing to meet the aforementioned standards with use of the cover 62 that covers the second screw 63.

Special screws, such as TORX screws, are higher in cost than conventional screws and are not very satisfactory in assemblability. Therefore, the reduction of the number of special screws used leads to a reduction in cost of the portable computer 61 and improvement of its assemblability.

If the cover 62 has the hook portion 65, it can be securely fixed by the hook portion 65 in cooperation with the first screw 23. Specifically, the hook portion 65 on the cover 62 enables the cover 62 to be securely fixed without the use of the second screw 63. When the distal end of the hook portion 65 engages with the lower surface 21*b* of the card module 21, the cover 62 can be securely fixed in the vertical direction of the module 21.

Figure 13:
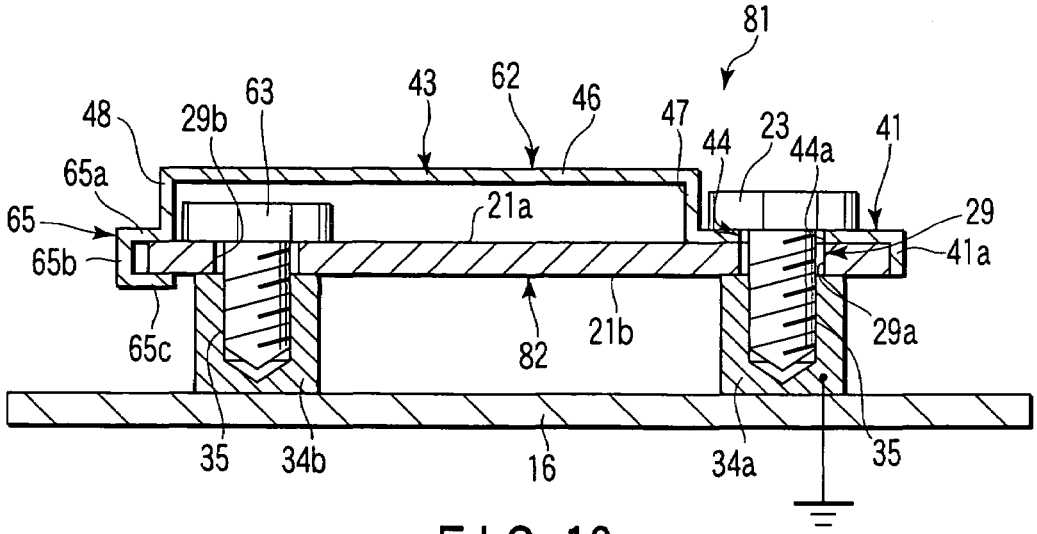
FIG. 13 is an examplary sectional view of a card module of a portable computer according to a third embodiment of the invention.

A portable computer 81 as an electronic apparatus according to a third embodiment of the invention will now be described with reference to FIG. 13. Like numerals are used to designate like configurations that have the same functions as those of the portable computers 1 and 61 according to the first and second embodiments, and a description of those configurations is omitted.

A case 4 of the portable computer 81 contains a card module 82, a cover 62, and first and second screws 23 and 63.

The module 82 has a connection pad portion 26, a mounting portion 27, and a first hole portion 29.

When the cover 62 is attached to the mounting portion 27, the second screw 63 is covered by the cover 62. When the cover 62 covers the second screw 63, a user is restricted from freely removing the second screw 63. If a special screw, such as a TORX screw, is used for the first screw 23, moreover, the user is restricted from freely removing the module itself.

According to the portable computer 81 constructed in this manner, members associated with the card module 82 can be mounted efficiently. Specifically, the first screw 23 is part of a fixture for fixing the module 82. The cover 62 is fixed by the use of the first screw 23. Since the first screw 23 is used to fix the cover 62, screws for fixing the cover 62 can be omitted. The omission of the screws for fixing the cover 62 leads to a reduction in cost of the portable computer 81, improvement of its assemblability, and enhancement of the mounting efficiency.

When the cover 62 covers the second screw 63, the user cannot freely disengage the second screw 63. Thus, if there are any standards to restrict the removal of the module, for example, the portable computer 81 can be obtained in better compliance with the standards.

In the case of the portable computer 81 according to the present embodiment, the conventional screw can be used for the second screw 63. If a special screw, such as a TORX screw, is used for the first screw 23, user removal can be restricted despite the use of the conventional screw for the second screw 63. Thus, the number of special screws used can be reduced without failing to meet the aforementioned standards.

Although the portable computers 1, 61 and 81 according to the first, second, and third embodiments have been described herein, it is to be understood that the present invention is not limited to those embodiments. Although the cover 22 is fixed by the two screws, for example, it may alternatively be fixed by only one screw or three or more screws. Thus, the removal of the cables 14*a* and 14*b* can be restricted only if the cover 22 has at least the first fixing portion 41 and the cover portion 43. Further, the cover 62 need not always be provided with the hook portion 65. Specifically, the removal of the second screw 63 can be restricted only if the cover 62 has at least the first fixing portion 41 and the cover portion 43. The fixture is expected only to have at least one fixing member. Each of the first and second hole portions must only have one hole.

The card modules 21 and 81 may be fixed to the case 4 in place of the circuit board 16. The first and second fixing members may be bolts instead of being screws. In this case, for example, hex head bolts or Allen bolts may be used as conventional bolts, while pinned Allen bolts, having a pin standing in their socket, and the like may be used as special bolts. It is to be understood that the retaining portion is not limited to the hook portion 65 but may be something like a latch that is fitted in a socket hole in the upper surface 21*a* of the card module 21, for example.

The embodiments of the present invention are widely applicable to any module that is attached to the circuit board 16 or the case 4 by means of a fixture, such as a screw or bolt. Electronic apparatuses to which the embodiments are applicable are not limited to portable computers. The embodiments are applicable to any other kinds of electronic apparatuses, such as cell phones, digital cameras, video cameras, personal digital assistants, etc.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An electronic apparatus comprising:

a case;

a module contained in the case and including a first hole, a second hole and a connector, the first hole and the second hole being arranged apart from each other with the connector therebetween;

a cable connected electrically to the connector;

a first fixing member inserted in the first hole and fixing the module in the case;

a second fixing member inserted in the second hole and fixing the module in the case; and a cover including a cover portion that covers the connector, wherein the cover portion covers the second fixing member inserted in the second hole, the cover includes a third hole communicating with the first hole, and is fixed in combination with the module by the first fixing member; and the cover further includes a retaining portion provided on an end portion thereof opposite from the third hole and anchored to an end portion of the module.

2. An electronic apparatus according to claim 1, wherein a distal end of the retaining portion engages one surface of the module opposite from the other surface to which the cover portion is opposed.

3. An electronic apparatus comprising:

a case;

a module contained in the case and including a first hole, a second hole and a connector, the first hole and the second hole being arranged apart from each other with the connector therebetween;

a cable connected electrically to the connector;

a first fixing member inserted in the first hole and fixing the module in the case;

a second fixing member inserted in the second hole and fixing the module in the case; and a removal preventing member including a fixing portion in which a third hole communicating with the first hole is open, and a cover portion covering the connector, wherein the removal preventing member includes a hook portion which engages an end portion of the module, and is fixed in the case by the first fixing member inserted in the third hole.

4. An electronic apparatus according to claim 3, wherein the removal preventing member is mounted so as to cover the second fixing member inserted in the second hole and is fixed by the hook portion and the first fixing member inserted in the third hole.

5. An electronic apparatus comprising:

a case;

a module contained in the case and including a first hole portion and a connector;

a cable connected electrically to the connector;

a fixture inserted in the first hole portion and fixing the module in the case; and a cover which covers the connector, includes a second hole portion communicating with the first hole portion, and is fixed in combination with the module by the fixture, wherein the module includes a mounting portion at one end portion thereof;

the connector and the first hole portion are arranged at the mounting portion, and the cover covers only the mounting portion in the module.

6. The electronic apparatus according to claim 5, wherein the cover restricts users' access to the connector in a state where an inside of the case is exposed to an outside of the case.

7. The electronic apparatus according to claim 5, wherein the first hole portion includes a first hole and a second hole arranged apart from each other with the connector therebetween, the fixture includes a first fixing member inserted in the first hole and a second fixing member inserted in the second hole, the second fixing member being attached to the module independently of the cover, and the cover includes a third hole communicating with the first hole, and is fixed by the first fixing member, the cover covering the second fixing member attached to the module.

8. The electronic apparatus according to claim 7, wherein the cover restricts users' free removal of the second fixing member.

9. The electronic apparatus according to claim 7, wherein the second fixing member is a conventional screw, and the first fixing member is a special screw in comparison with the second fixing member.

10. The electronic apparatus according to claim 5, wherein:

the first hole portion includes a first hole and a second hole arranged apart from each other with the connector therebetween;

the second hole portion includes a third hole and a fourth hole communicating with the first hole and the second hole, respectively; and the fixture includes a first fixing member inserted in the first and third holes and a second fixing member inserted in the second and fourth holes.

11. The electronic apparatus according to claim 5, wherein the cover includes a hole communicating with the first hole portion, and a retaining portion provided on an end portion thereof opposite from the hole and anchored to an end portion of the module.

* * * * *